US012435728B2

(12) United States Patent
Asano et al.

(10) Patent No.: US 12,435,728 B2
(45) Date of Patent: Oct. 7, 2025

(54) TURBOFAN AND AIR-CONDITIONING APPARATUS

(71) Applicant: Mitsubishi Electric Corporation, Tokyo (JP)

(72) Inventors: Ryutaro Asano, Tokyo (JP); Tomoya Fukui, Tokyo (JP); Kazuki Isomura, Tokyo (JP); Makoto Kurihara, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 134 days.

(21) Appl. No.: 18/028,768

(22) PCT Filed: Nov. 25, 2020

(86) PCT No.: PCT/JP2020/043872
§ 371 (c)(1),
(2) Date: Mar. 28, 2023

(87) PCT Pub. No.: WO2022/113217
PCT Pub. Date: Jun. 2, 2022

(65) Prior Publication Data

US 2023/0332615 A1 Oct. 19, 2023

(51) Int. Cl.
*F04D 29/28* (2006.01)
*F04D 17/08* (2006.01)
(Continued)

(52) U.S. Cl.
CPC ..... *F04D 29/281* (2013.01); *F04D 17/08* (2013.01); *F04D 29/5826* (2013.01); *F24F 1/0022* (2013.01)

(58) Field of Classification Search
CPC ..... F04D 17/08; F04D 29/281; F04D 29/282; F04D 29/30; F04D 29/5826; F05D 2240/303; F05D 2240/304
See application file for complete search history.

(56) References Cited

U.S. PATENT DOCUMENTS

2010/0202886 A1 8/2010 Iwata et al.
2012/0055656 A1* 3/2012 Han ..... F04D 29/30 165/122
(Continued)

FOREIGN PATENT DOCUMENTS

EP 3315786 A1 5/2018
JP 2009-174541 A 8/2009
(Continued)

OTHER PUBLICATIONS

English Translation of WO 2020080260, Sato et al. ( Apr. 23, 2020). (Year: 2020).*
(Continued)

*Primary Examiner* — Nathaniel E Wiehe
*Assistant Examiner* — Aye S Htay
(74) *Attorney, Agent, or Firm* — XSENSUS LLP

(57) ABSTRACT

In a turbofan, a first curve, formed by projecting a leading edge onto a plane perpendicular to a rotating shaft, has a first inflection point and has a portion that is convex at a point closer to the first inflection point than the first point is in a counter-rotational direction and a portion that is convex at a point closer to the second point than the first inflection point is in the rotational direction, the first point is located forward of the second point in the rotational direction, a second curve, formed by projecting the trailing edge onto a plane perpendicular to the rotating shaft, follows an arc centered on the rotating shaft in a top view, a third curve, formed by projecting the trailing edge onto a cylindrical plane coaxial with the rotating shaft, is formed so as to be convex in the rotational direction, and a junction point of the third curve and the shroud is located behind the junction point of the third curve and the main plate in the rotational direction.

9 Claims, 15 Drawing Sheets

(51) Int. Cl.
*F04D 29/58* (2006.01)
*F24F 1/0022* (2019.01)

(56) References Cited

U.S. PATENT DOCUMENTS

| | | | | |
|---|---|---|---|---|
| 2012/0063899 | A1* | 3/2012 | Ikeda | F04D 29/245<br>416/185 |
| 2015/0226227 | A1* | 8/2015 | Ikeda | F04D 29/281<br>416/182 |
| 2015/0345511 | A1* | 12/2015 | Son | F04D 29/403<br>415/203 |

FOREIGN PATENT DOCUMENTS

| | | | | |
|---|---|---|---|---|
| JP | 2019-019759 | A | 2/2019 | |
| JP | 2019-027327 | A | 2/2019 | |
| JP | 6642913 | B2 | 2/2020 | |
| WO | WO-2020080260 | A1 * | 4/2020 | E02F 9/0866 |

OTHER PUBLICATIONS

International Search Report and Written Opinion mailed on Dec. 28, 2020, received for PCT Application PCT/JP2020/043872, filed on Nov. 25, 2020, 10 pages including English Translation.
Office Action issued Apr. 4, 2024 in Great Britain Patent Application No. GB2306240.9, 5 pages.

* cited by examiner

TURBOFAN AND AIR-CONDITIONING APPARATUS

CROSS-REFERENCE TO RELATED APPLICATION

The present application is based on PCT filing PCT/JP2020/043872, filed Nov. 25, 2020, the entire contents of which are incorporated herein by reference.

TECHNICAL FIELD

The present disclosure relates to a turbofan having swept-back blades, and an air-conditioning apparatus.

BACKGROUND ART

A turbofan has a configuration in which an airflow sucked in an axial direction is re-directed in a radial direction by centrifugal force and is then blown out. Therefore, the sucked airflow flows unevenly toward a main plate side by inertia, and hence the blade cannot work sufficiently for the airflow on a shroud side. If separation occurs in the airflow on the shroud side, pressure resistance increases, resulting in a reduced fan efficiency. In addition, since an airflow blown out has a high velocity, the airflow collides with heat exchangers and other structures provided outside the turbofan, which increases pressure loss or worsens noise problem. The above problem is particularly significant when a specific speed is relatively increased in an air-conditioning apparatus. A specific speed means a rotational speed required for generating an airflow per unit of time.

In Patent Literature 1, a leading edge and a trailing edge of a blade are made concave in the airflow direction, or the blade is curved, to thereby reduce a load imposed on the blade and suppress occurrence of separation, whereby a reduction of noise and an increase in efficiency are realized.

CITATION LIST

Patent Literature

Patent Literature 1: Japan Patent No. 6642913

SUMMARY OF INVENTION

Technical Problem

A blade disclosed in Patent Literature 1 has a shape in which the trailing edge of the blade is concave in the direction along the airflow, i.e., along the camber line, which is the center line in the thickness direction of the blade. This results in a decrease in the net diameter of the blade and a degradation in air-sending performance, such as an increase in pressure or a decrease in air volume.

Also known is a technology that improves air-sending characteristics and noise characteristics while maintaining an overall size of a fan by expanding a surface area of a blade by curving the blade concavo-convexly in the direction of the rotating shaft. However, in this technology, the airflow flowing into the blade tends to be unevenly present in the direction of a rotating shaft and has three-dimensionality. As a result, the airflow does not flow along a cross section of the blade, which may result in separation in a negative pressure surface on the shroud side, uneven velocity distribution at a blade outlet, or other problems.

The present disclosure has been made in order to solve the above-mentioned problems and an object thereof is to provide a turbofan and an air-conditioning apparatus that suppress deterioration in air-sending performance and an uneven velocity distribution.

Solution to Problem

The turbofan according to one embodiment of the present disclosure is a turbofan comprising: a main plate provided with a hub to which a rotating shaft is connected, a shroud positioned so as to face the main plate, and a plurality of blades positioned between the main plate and the shroud, each of the plurality of blades has a leading edge and a trailing edge, the trailing edge being located further from the rotating shaft than the leading edge, the leading edge being located forward in a rotational direction than the trailing edge, when a junction point of the leading edge with the main plate is named as a first point, and an intersection of the leading edge and an imaginary plane passing through an outermost circumference of the shroud and being perpendicular to the rotating shaft is named as a second point, a first curve, formed by projecting the leading edge onto a plane perpendicular to the rotating shaft, has a first inflection point relative to a coordinate system in which an imaginary straight line passing through the first point and the second point is an abscissa and the rotational direction side is positive in a top view as viewed in the axial direction of the rotary shaft, the first curve has a portion that is convex at a point closer to the first inflection point than the first point is in a counter-rotational direction and a portion that is convex at a point closer to the second point than the first inflection point is in the rotational direction, the first point is located forward of the second point in a rotational direction, a second curve, formed by projecting the trailing edge onto a plane perpendicular to the rotating shaft, follows an arc centered on the rotating shaft in a top view as viewed in the axial direction of the rotating shaft, a third curve, formed by projecting the trailing edge onto a cylindrical plane coaxial with the rotating shaft, is formed so as to be convex in the rotational direction, and a junction point of the third curve and the shroud is located behind the junction point of the third curve and the main plate in the rotational direction.

Advantageous Effects of Invention

According to the turbofan of one embodiment of the present disclosure, an area where a distance between the leading edge of the blade and the rotating shaft is decreased is enlarged and the leading edge on the main plate side is located forward of the leading edge on the shroud side in the rotational direction, which prevents a decrease in airflow suction efficiency and thus improves air-sending performance. In addition, since the trailing edge of the blade is convex in the rotational direction, and the trailing edge on the shroud side is positioned behind a trailing edge on the main plate side in the rotational direction, which helps to suppress uneven velocity distribution at the blade outlet.

DESCRIPTION OF EMBODIMENTS

Hereinbelow, a turbofan according to the embodiments will be described with reference to the drawings. In the following drawings, the relative dimensional relationship and the shape or the like of each component may differ from the actual ones. In the following drawings, components or parts with same reference signs are the same or equivalent, and this is applied to the full text of the specification. In addition, in order to facilitate understanding, in the following description, directional terms such as "upper", "lower", "right", "left", "front" or "rear" are used as appropriate. However, these directional terms are given only for descriptive purposes and are not intended to limit the placement or orientation of devices or components.

Embodiment 1

<Configuration of Turbofan 100>

Figure 1:
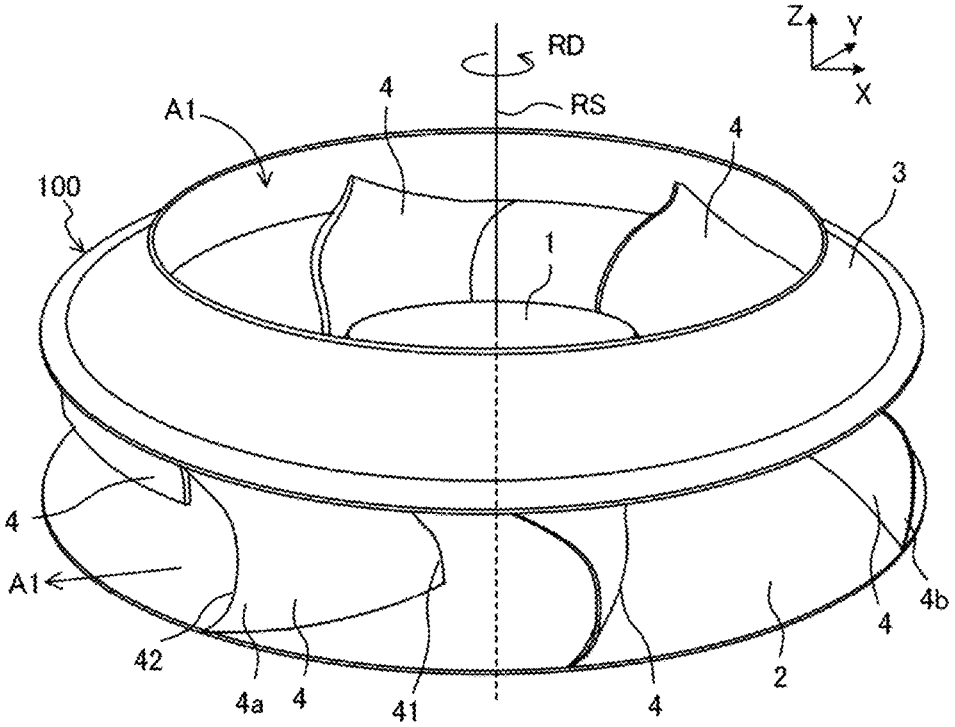
FIG. 1 is a schematic perspective view of a turbofan according to Embodiment 1.

FIG. 1 is a schematic perspective view of a turbofan 100 according to Embodiment 1. The turbofan 100 has a main plate 2 provided with a hub 1, a shroud 3, which is annular in shape, positioned so as to face the main plate 2, and a plurality of blades 4 positioned between the main plate 2 and the shroud 3. The hub 1 is located in the center of the main plate 2, and the rotating shaft RS is connected to the hub 1.

In FIG. 1, an XY plane is a plane perpendicular to the rotating shaft RS and is perpendicular to the Z direction. The shroud 3 is positioned in the Z direction, in such a manner that it is spaced from the main plate 2.

The turbofan 100 is driven by an unillustrated motor in the rotational direction RD around the rotating shaft RS. The turbofan 100, when driven to rotate, sucks an airflow A1 in the axial direction of the rotating shaft RS and blows out the sucked airflow A1 outward in the radial direction by a centrifugal force generated by the rotation.

Figure 12:
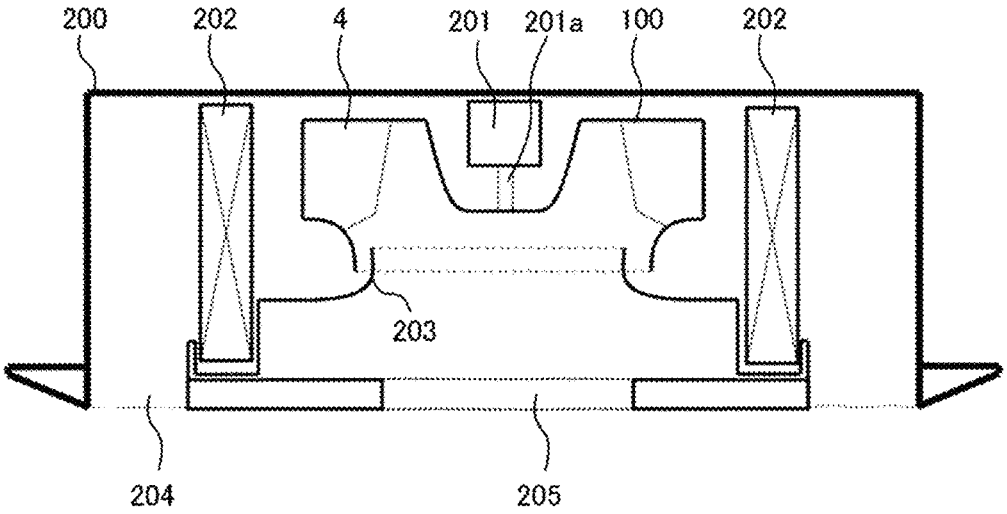
FIG. 12 is a schematic view illustrating an inside of an air-conditioning apparatus according to Embodiment 6.

The hub 1 is circular in shape when it is projected along the rotating shaft RS. In other words, the hub 1 is circular when viewed in the axial direction of the rotating shaft RS. The hub 1 is formed in a conical trapezoidal shape that rises like a mountain from the main plate 2 side toward the shroud 3 side. A shaft 201*a* of a motor 201 is connected to the hub 1, as shown in FIG. 12 given below. The shape of the hub 1 is not limited to the above shape, and the hub 1 may be of any other shape. In order to cool the motor 201, the hub 1 may have holes for air to pass through.

The main plate 2 has the hub 1. The main plate 2 rotates with the hub 1 driven by a motor. The plurality of blades 4 are connected to the main plate 2. The main plate 2 is formed in a disk-like shape. The shape of the main plate 2 is, however, not limited to a disk-like shape. The main plate 2 may, for example, be formed in a mountain-like shape around the hub 1. The shape of an outer edge of the main plate 2 is not limited to a circular shape with a fixed outer diameter, but may also be a polygonal shape with a varying outer diameter, or may be other shapes.

The shroud 3 forms an air guide wall to direct air to an air-inlet side of the turbofan 100. Due to presence of the plurality of blades 4, a distance between the main plate 2 and the shroud 3 is maintained at a constant value. The shroud 3 is a trumpet-like shape in which the diameter changes to expand. The shroud 3 is formed such that the diameter of an opening thereof increases from an air inlet to an air outlet of the turbofan 100. The shroud 3 is formed in a mountain-like shape rising from an outer part in the radial direction toward the center.

The plurality of blades 4 are positioned between the main plate 2 and the shroud 3 and are connected to the main plate 2 and the shroud 3. The plurality of blades 4 rotate together with the main plate 2 to send air inside the turbofan 100 to an outer peripheral side. The plurality of blades 4 each have a leading edge 41 and a trailing edge 42 that is located further from the rotating shaft RS than the leading edge 41. The leading edge 41 of each of the plurality of blades 4 is located forward of, in the rotational direction RD, the trailing edge 42. That is, the plurality of blades 4 are sweptback blades. The plurality of blades 4 are arranged at predetermined intervals around a circumference centered on the rotating shaft RS. The plurality of blades 4 may be arranged at the same intervals or may be arranged at different intervals.

Since the plurality of blades 4 have the same characteristics, one of the plurality of blades 4 will be described. The blade 4 has an outer surface 4*a* and an inner surface 4*b*, which is a back surface of the outer surface 4*a*. The inner surface 4*b* is located closer to the rotating shaft RS than the outer surface 4*a* is. The outer surface 4*a* is a positive pressure surface that receives a pressure higher than the air pressure, and the inner surface 4*b* is a negative pressure surface that receives a pressure lower than the air pressure. The blade 4 has a shape in which its thickness gradually decreases, along a camber line, from a position where it has a maximum thickness on the camber line to either the leading edge side or the trailing edge side. The camber line is a center line in the thickness direction of the blade 4.

In other words, the blade 4 has a general airfoil shape in cross section in a plane perpendicular to the rotating shaft RS, i.e., in a plane parallel to the XY plane. The change in thickness along the camber line of the blade 4 is not monotonous, but there may be areas where the change in thickness varies in the middle of the camber line.

<Configuration of Blade 4>

Figure 2:
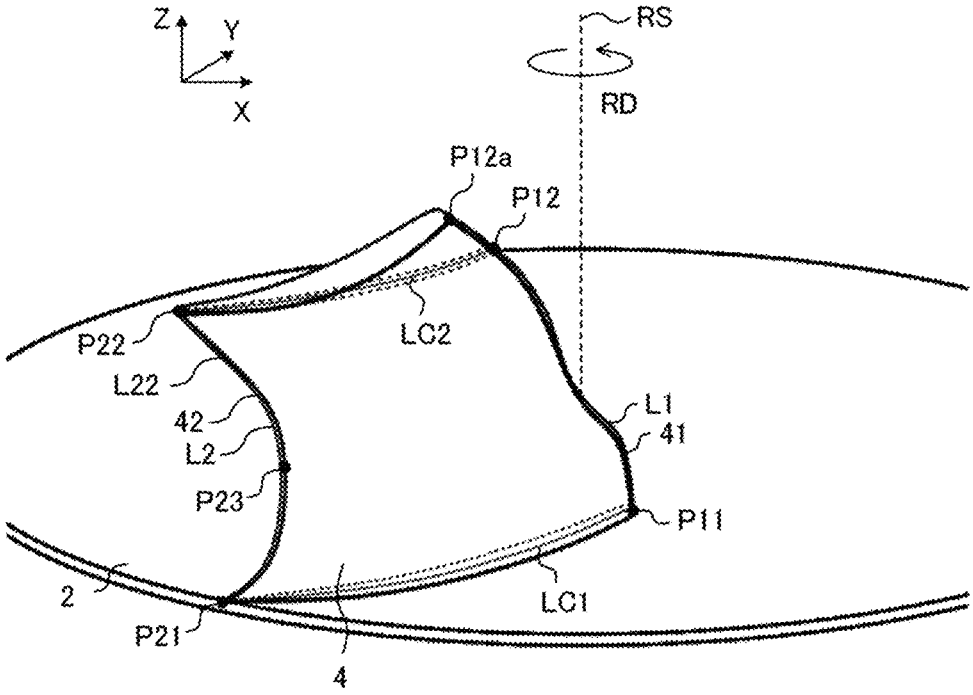
FIG. 2 is a perspective view of essential parts of a main plate and a blade of the turbofan according to Embodiment 1.
Figure 3:
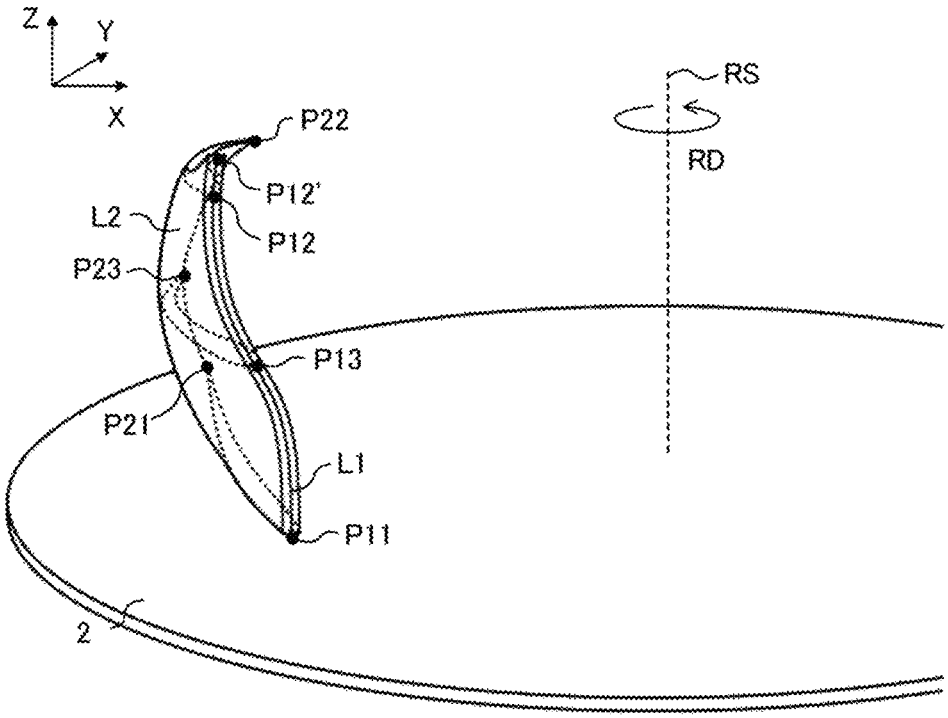
FIG. 3 is a perspective view of essential parts of the main plate and the blade of the turbofan according to Embodiment 1, as viewed in a direction different from that in FIG. 2.
Figure 4:
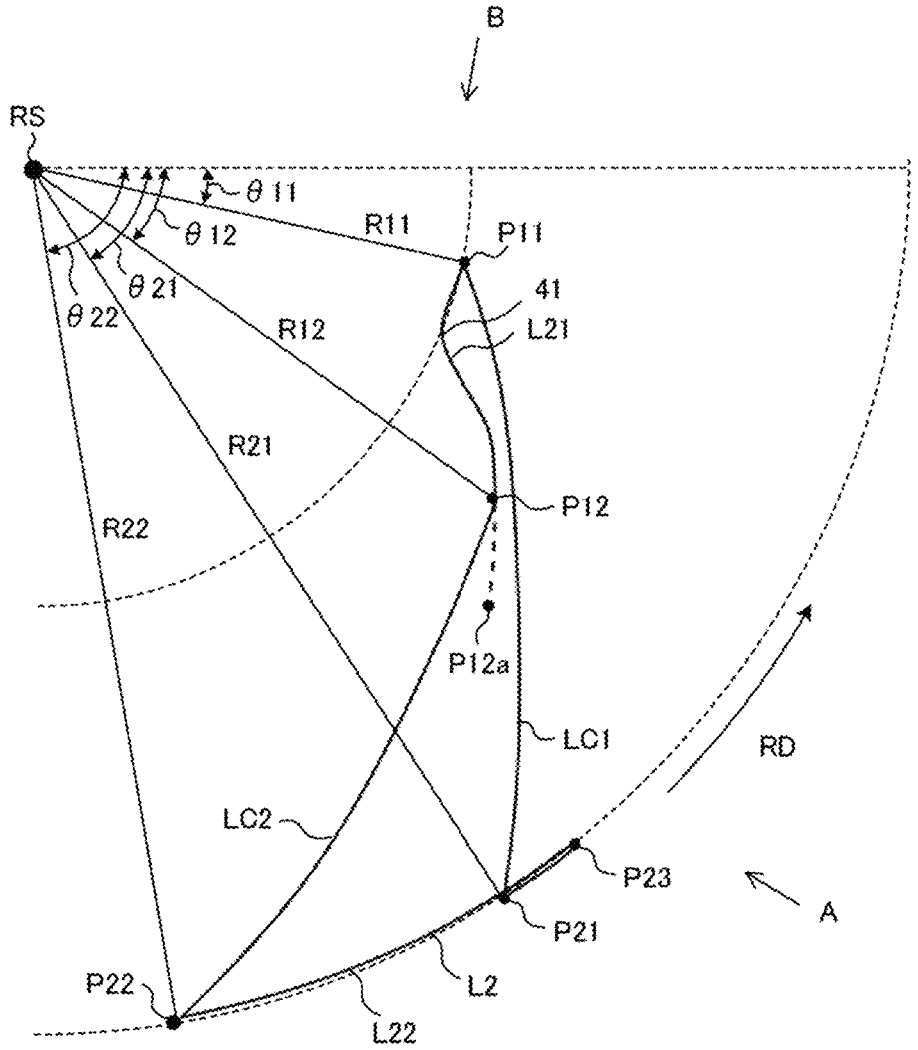
FIG. 4 is a top view of the blade of the turbofan according to Embodiment 1, as viewed in the axial direction of a rotating shaft.

FIG. 2 is a perspective view of essential parts of the main plate 2 and the blade 4 of the turbofan 100 according to Embodiment 1, FIG. 3 is a perspective view of essential parts of the main plate 2 and the blade 4 of the turbofan 100 according to Embodiment 1, as viewed in a direction different from that in FIG. 2. FIGS. 2 and 3 each illustrates a state in which the shroud 3 is removed, FIG. 4 is a top view of the blade 4 of the turbofan 100 according to Embodiment 1, as viewed in the axial direction of a rotating shaft RS. In FIG. 4, arrow A shows the direction of observation of the essential parts of the main plate 2 and the blade 4 of the turbofan 100 in FIG. 2, and arrow B shows the direction of observation of the essential parts of the main plate 2 and the blade 4 of the turbofan 100 in FIG. 3.

As shown in FIGS. 2 to 4, the blade 4 is, for example, shaped so that the camber line, which is the center line in the thickness direction of the plane perpendicular to the rotating shaft RS, is convex in the rotational direction RD. The shape of the cross section which is a plane perpendicular to the rotating shaft RS of the blade 4 and parallel to the XY plane is a general airfoil shape.

The center line in the thickness direction of the blade 4 in a cross section where the blade 4 contacts the main plate 2 is defined as a camber line LC1. The leading edge 41 of the camber line LC1 in a cross section tangent to the main plate 2 is defined as point P11. In other words, point P11 is the point where the leading edge 41 and the main plate 2 are in contact with each other, and is an example of the first point. The trailing edge 42 of the camber line LC1 in the cross section tangent to the main plate 2 is defined as point P21.

A center line in the thickness direction of the blade 4 in a cross section of the plane perpendicular to the rotating shaft RS at a position that is the height of the outermost circumference part of the shroud 3 when the shroud 3 is attached to the blade 4 is defined as a camber line LC2. The leading edge 41 of the camber line LC2 at the height position of the outermost circumference part of the shroud 3 is defined as point P12. That is, point P12 is an intersection of the leading edge 41 and the plane perpendicular to the rotating shaft RS passing through the outermost circumference of the shroud 3, and is an example of a second point. The trailing edge 42 of the camber line LC2 at the height position of the outermost circumference part of the shroud 3 is defined as point P22.

Among points of contact between the blade 4 and the shroud 3, a point that is farthest from the main plate 2 is defined as point P12*a*, e.g. a third point. A trajectory formed by the leading edge 41 from point P11 to point P12*a* is defined a leading edge line L1. A trajectory formed by the trailing edge 42 from point P21 to point P22 is defined as a trailing edge line L2.

<Configuration of Leading Edge 41>

Figure 5:
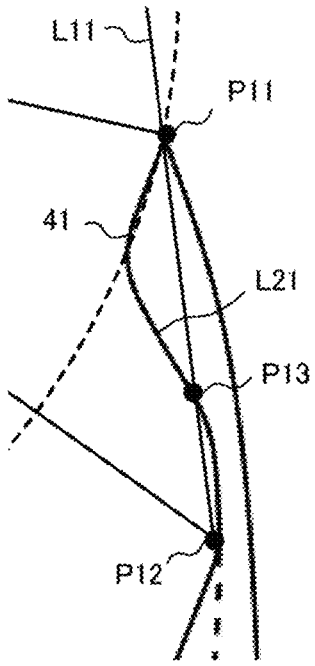
FIG. 5 is an enlarged view of the essential parts shown in FIG. 4.

FIG. 5 is an enlarged view of the essential parts shown in FIG. 4. In FIG. 5, a coordinate system is considered in which a first straight line L11 passing through points P11 and P12 is the abscissa, and an area perpendicular to the first straight line L11, and is located on the rotational direction RD side of blade 4, i.e., a pressure surface side, is positive. A line formed by projecting the leading edge line L1 onto the plane perpendicular to the rotating shaft RS is defined as a first curve L21.

The leading edge 41 of the blade 4 is shaped such that the first curve L21 has a first inflection point P13 in the coordinate system in which the first straight line L11 serves as the abscissa, as viewed from the top in the axial direction of the rotating shaft RS. The first curve L21, as viewed from the top of the leading edge 41 of the blade 4, is an S-shaped curve with a convex part in the counter-rotational direction between point P11 and the first inflection point P13 and a convex part in the rotational direction RD between the point P12 and the first inflection point P13.

Here, a polar coordinate system using distance R and angle θ as shown in FIG. 4 is considered. In this polar coordinate system, the coordinate component of point P11 is P11 (R11, θ11) and the coordinate component of point P12 is P12 (R12, θ12). The distance R is the distance from the rotating shaft RS to an arbitrary point. The angle θ is an angle when the counter-rotational direction is positive relative to an arbitrary imaginary line passing through the rotating shaft RS.

In this polar coordinate system, the first curve L21 is a curve satisfying R11<R12 and θ11<θ12. In other words, in the leading edge L1, the point P11 on the main plate 2 side is located on the inner side of the radial direction, which is shorter in distance from the rotating shaft RS than point P12*a* on the shroud 3 side. In the leading edge line L1, point P11 on the main plate 2 side is located forward of point P12*a* on the shroud 3 side in the rotational direction RD.

Due to an S-shape with a convex part in the counter-rotational direction on the main plate 2 side of the leading edge line L1, an area in which the distance from the rotating shaft RS to the leading edge 41 is shorter than the distance between the rotating shaft RS and the first straight line L11 is increased on the main plate 2 side. Therefore, the airflow concentrated on the main plate 2 side due to inertia is effectively sucked into the turbofan 100.

The leading edge 41 on the main plate 2 side is located forward in the rotational direction RD, so that the airflow on the main plate 2 side is not disturbed by the blade 4 on the shroud 3 side, and the airflow is effectively sucked in from the blade 4 on the main plate 2 side.

<Configuration of Trailing Edge 42>

The trailing edge 42 of the blade 4 is shaped such that the trailing edge line L2 passes from point P21 on the main plate 2 side to point P23, which is forward of point P21 on the main plate 2 side in the rotational direction RD, and from point P23, it moves backward in the rotational direction RD to reach point P22 on the shroud 3 side. Point P23 is a point located most forward of the trailing edge line L2 in the rotational direction RD.

The trailing edge line L2 draws a second curve L22 when projected onto a plane perpendicular to the rotating shaft RS, as shown in FIG. 4. The second curve L22 follows a trajectory along an arc centered on the rotating shaft RS in a top view as viewed in the axial direction of the rotating shaft RS.

Figure 6:
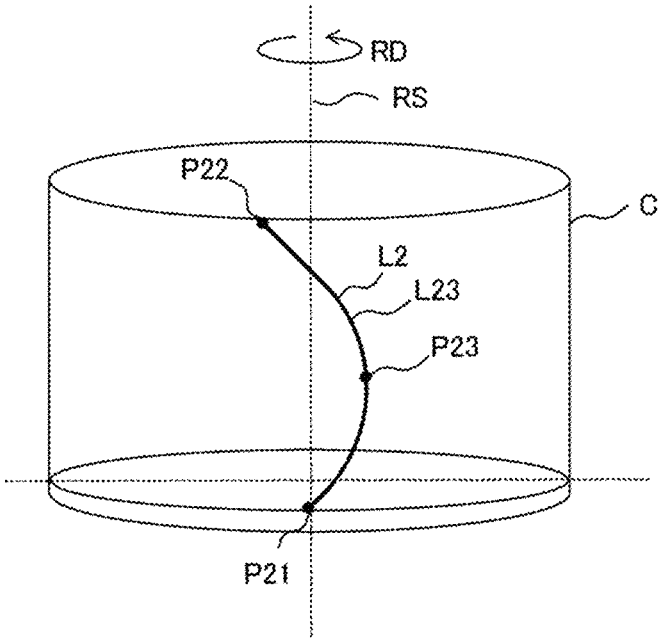
FIG. 6 is a schematic view of the trailing edge line of the blade of the turbofan according to Embodiment 1, in which the trailing edge line is projected onto an imaginary cylindrical plane centered on the rotating shaft.

FIG. 6 is a schematic view of the trailing edge line L2 of the blade 4 of the turbofan 100 according to Embodiment 1, in which the trailing edge line L2 is projected onto an imaginary cylindrical plane C centered on the rotating shaft RS. As shown in FIG. 6, the trailing edge line L2 of the blade 4, when projected onto the imaginary cylindrical plane C centered on the rotating shaft RS, draws a third curve L23. In the imaginary cylindrical plane C centered on the rotating shaft RS, the third curve L23 follows a trajectory from P21, which is the junction point with the main plate 2, to P22, which is the junction point with the shroud 3, while drawing a convex U-shape toward the front of the rotational direction RD.

As described above, considered is a polar coordinate system that uses, in a plane perpendicular to the rotating shaft RS, the distance R from the rotating shaft RS and the angle θ, where an arbitrary imaginary curve passing through the rotating shaft RS is the reference and the counter-rotational direction is positive. In the trailing edge line L2, point P21 on the main plate 2 side is located forward of point P22 on the shroud 3 side in the rotational direction RD. In other words, in the rotational direction RD, point P21, which is the junction point of the third curve L23 and the main plate 2, is located forward of point P22, which is the junction point of the third curve L23 and the shroud 3. In the polar coordinate system, the second curve L22 is a curve that satisfies θ21<θ22 when the coordinate components of point P21 and P22 are P21 (R21, θ21) and (R22, θ22), respectively.

Since the trailing edge line L2 has the above-mentioned configuration, the airflow concentrated on the main plate 2 side is dispersed from the main plate 2 side to the shroud 3 side in the process of moving along the rotating blade 4 toward the air-outlet side, thus equalizing the air velocity distribution of the airflow on the outer surface 4*a* of the blade 4.

It suffices that the second curve L22 follow an arc centered on the rotating shaft RS. For example, a fine, sawtooth-like serration may be provided on the trailing edge 42 of the blade 4. Even if the position in the radial direction of the trailing edge 42, i.e., the second curve L22, is not on a perfect arc centered on the rotating shaft RS, it does not affect adversely effects obtained by the second curve L22. If the second curve L22 does not deviate excessively from the arc centered on the rotating shaft RS, the outer diameter of the blade 4 will not fluctuate and hence the air-sending performance can be maintained.

The change in the position of the trailing edge 42 in the rotational direction RD from point P21 to point P23 or from point P23 to point P22 is not necessarily monotonic. If the positional relationship of points P21, P22, and P23 is within the range satisfying the aforementioned positional relationship, there may be portions in part of the trailing edge 42 where the direction of change is reversed.

Thus, in Embodiment 1, the leading edge 41 of the blade 4 is shaped such that the leading edge line L1 draws an S-shape having a convex part in the counter-rotational direction on the main plate 2 side in a top view as viewed in the axial direction of the rotating shaft RS, thereby improving the air-sending characteristics of the turbofan 100.

The leading edge 41 on the main plate 2 side is shaped to be located forward of the leading edge 41 on the shroud 3 side in the rotational direction RD, This allows the airflow to be effectively sucked in by the blade 4 on the main plate 2 side without being disturbed by the blade 4 on the shroud 3 side.

Furthermore, due to the shape of the trailing edge line L2, the airflow that is sucked efficiently is dispersed from the main plate 2 side to the shroud 3 side as it moves along the blade 4 toward the air-outlet side, resulting in a more uniform air velocity distribution. This allows air to flow without separation of a negative pressure surface on the shroud 3 side or unbalanced velocity distribution at the outlet of the blade 4, thereby preventing adverse effects on fan efficiency and noise.

For example, if the leading edge line L1 of the blade 4 is not in an S-shape with a convex part in the counter-rotational direction on the main plate 2 side, on the main plate 2 side, where the airflow is concentrated, the area where the leading edge 41 is located on the inner diameter side relative to the rotating shaft RS is more restricted than other areas. The case where the leading edge line L1 is not in an S-shape having a convex part in the counter-rotational direction on the main plate 2 side is, for example, a case where the trajectory of the leading edge 41 of the blade 4 is linear in the top view, or a case where it is in an S-shape having a convex part in the rotational direction RD on the main plate 2 side and is convex in the counter-rotational direction on the shroud 3 side. On the main plate 2 side, if the range of an area where the leading edge 41 is located on the inner diameter side of the main plate 2 than other areas is restricted, the amount of sucked air is also restricted on the main plate 2 side. If the position of the leading edge 41 in the rotational direction RD is the same on the main plate 2 side and the shroud 3 side, the airflow is disturbed by the blade 4 on the shroud 3 side, and the airflow cannot be effectively sucked to the main plate 2 side.

In contrast, by making the leading edge line L1 of the blade 4 have an S-shape having a convex part in the counter-rotational direction in the top view, as in Embodiment 1, the range of the area where the leading edge 41 is located on the inner diameter side of the main plate 2 as compared with other areas can be expanded, as compared with a case where the leading edge 41 of the blade 4 is linear. This effectively draws an airflow into the main plate 2 side where the flow is concentrated by inertia, improving the air-sending performance of the turbofan.

For example, if a configuration is designed in which airflow concentrated on the main plate 2 side is sucked efficiently, separation in a negative pressure surface on the shroud 3 side or uneven velocity distribution at the outlet of the blade 4 may occur. In this case, for example, the entire blade 4 may be curved concavo-convexly in the direction of the rotating shaft in order to enlarge the surface area of the blade 4 and improve the air-sending characteristics and noise characteristics. However, even when the blade 4 is made to have a concave or convex part in the axial direction, if the cross-sectional shape of the blade 4 from the leading edge to the trailing edge is substantially identical in the axial direction of the rotating shaft RS, there is a possibility that the airflow flowing into the blade 4 will be unevenly present in the axial direction of the rotating shaft RS, or the airflow with three-dimensionality will not follow the cross section of the blade 4.

In contrast, in the blade 4 of Embodiment 1, the airflow that flows into the blade 4 and is concentrated on the main plate 2 side is directed along the blade 4 to the air-outlet side due to the shape of the trailing edge line L2, and is dispersed from the main plate 2 side to the shroud 3 side at the air-outlet side. As a result, the velocity distribution of the airflow that flows unevenly into the main plate 2 side due to inertia becomes more uniform, and worsening of noise problem by separation of the airflow at the negative pressure surface on the shroud 3 side or an uneven velocity distribution of the airflow at the air outlet of the turbofan 100 can be suppressed.

This simultaneously allows the turbofan 100 to improve air-sending performance, to enhance fan efficiency, and to reduce generation of noise from the fan.

According to the turbofan 100 of Embodiment 1 described above, the main plate 2 side of the leading edge 41 is shaped such that the first curve L21, when the leading edge 41 is viewed from the top in the axial direction of the rotating shaft RS, is in an S-shape with a convex part in a counter-rotational direction. As a result, an area, where a distance from the rotating shaft RS to the leading edge 41 is shorter than a distance between the rotating shaft RS and the first straight line L11, increases on the main plate 2 side. Therefore, an airflow concentrated on the main plate 2 side of the leading edge 41 due to inertia is effectively sucked in, thus improving the air-sending characteristics. The main plate 2 side of the leading edge 41 is shaped so as to be located forward of the leading edge 41 on the shroud 3 side in the rotational direction RD. This allows the airflow to be effectively sucked in by the blade 4 on the main plate 2 side without being disturbed by the blade 4 on the shroud 3 side. The trailing edge 42 has a shape in which the second curve L22, when viewed from the top, is on an arc centered on the rotating shaft RS, and the third curve L23, when viewed from the cylindrical plane C, is convex in the rotational direction RD, with the main plate 2 side being positioned further forward in the rotational direction RD than the shroud 3 side. As a result, the airflow, of which the uneven concentration toward the main plate 2 side is promoted on the leading edge 41 side, is uniformly distributed from the main plate 2 side to the shroud 3 side, preventing worsening of noise problem caused by airflow separation at the negative pressure surface on the shroud 3 side. Thus, deterioration of air-sending property in the turbofan 100 and uneven velocity distribution at the outlet of the blade 4 are suppressed.

In particular, if the number of the first inflection point P13 in the first curve L21 is one, the three-dimensionality of the sucked airflow, i.e., the axial component of the airflow, prevents turbulence in the airflow at the leading edge. This allows the airflow to flow smoothly toward the trailing edge, further suppressing reduction in suction efficiency of the airflow in the turbofan 100 and uneven velocity distribution at the outlet of the blade 4.

Embodiment 2

Figure 7:
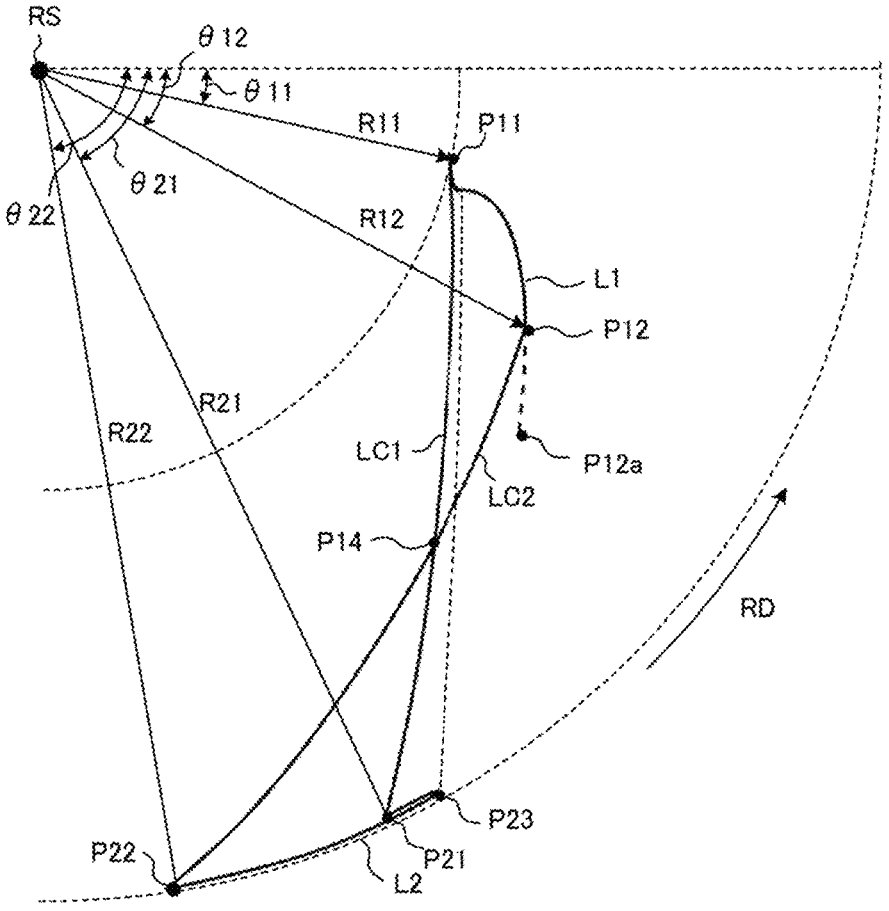
FIG. 7 is a top view of a blade of a turbofan according to Embodiment 2, as viewed in the axial direction of the rotating shaft.

FIG. 7 is a top view of a blade 4 of a turbofan 100 according to Embodiment 2, as viewed in the axial direction of the rotating shaft RS. Since the configuration of Embodiment 2 differs from that of Embodiment 1 in the configuration of the blade 4 and is otherwise similar to that of Embodiment 1, the explanation is omitted and similar or equivalent parts are marked with the same referential signs.

As shown in FIG. 7, the blade 4 of Embodiment 2 has a configuration in which the camber line LC1 on the main plate 2 side and the camber line LC2 on the shroud 3 side cross each other at point P14 in the top view as viewed in the axial direction of the rotating shaft RS. The camber line LC1 on the main plate 2 side is the center line in the thickness direction of the blade 4 on the surface where the blade 4 contacts the main plate 2. The camber line LC2 on the shroud 3 side is the center line in the thickness direction of the blade 4 in an imaginary plane perpendicular to the rotating shaft RS passing through the outermost circumference of the shroud 3 of the blade 4. In the configuration where the camber line LC1 on the main plate 2 side and the camber line LC2 on the shroud 3 side intersect, an area of the negative pressure surface of the blade 4 seen when the blade 4 is viewed from the air-inlet side is increased as compared to the configuration where they do not intersect. The negative pressure surface of the blade 4 is, in other words, the inner surface 4*b* of the blade 4.

The inner surface 4*b* visible from the air-inlet side of the blade 4 is an area that is mainly located on the shroud 3 side in the blade 4. By increasing the area of the inner surface 4*b*, which is visible when the blade 4 is viewed from the air-inlet side, air can easily flow toward the negative pressure side of the blade 4 on the shroud 3 side, and airflow separation from the negative pressure side of the blade 4 on the shroud 3 side is more effectively suppressed.

According to the turbofan 100 according to Embodiment 2 described above, since the area of the negative pressure surface of the blade 4 visible from the air-inlet side is increased, the airflow is allowed to flow toward the negative pressure surface of the blade 4 on the shroud 3 side more easily. As a result, separation of an airflow from the negative pressure surface of the blade 4 on the shroud 3 side is more effectively suppressed, which improves fan efficiency and reduces fan noise.

Embodiment 3

Figure 8:
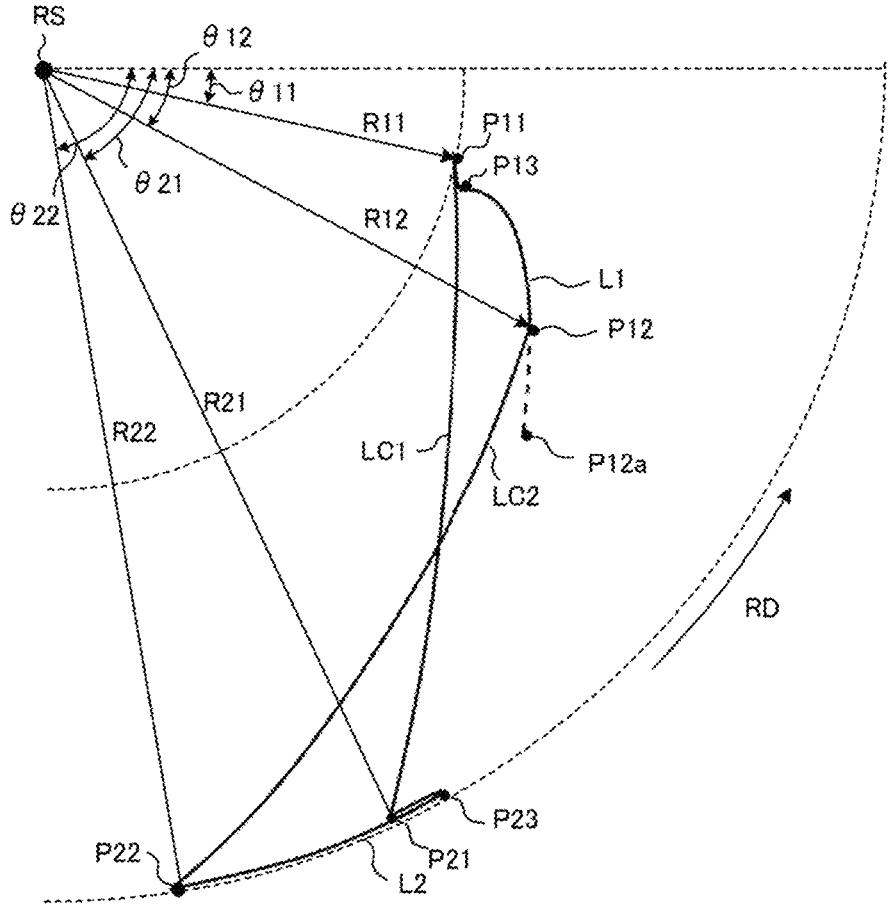
FIG. 8 is a top view of a blade of a turbofan according to Embodiment 3, as viewed in the axial direction of a rotating shaft.

FIG. 8 is a top view of a blade 4 of a turbofan 100 according to Embodiment 3 as viewed in the axial direction of a rotating shaft RS. Since the configuration of Embodiment 3 differs from that of Embodiment 1 in the configuration of the blade 4 and is otherwise similar to that of Embodiment 1, the explanation is omitted and similar or equivalent parts are marked with the same referential signs.

In the turbofan 100 of Embodiment 3, the first inflection point P13 at the leading edge line L1 is closer to the point P11 than to the point P12 in terms of a linear distance in the top view in the axial direction of the rotating shaft RS. In other words, the distance between the first inflection point P13 and the point 11 is shorter than the distance between the first inflection point P13 and the point P12.

Figure 9:
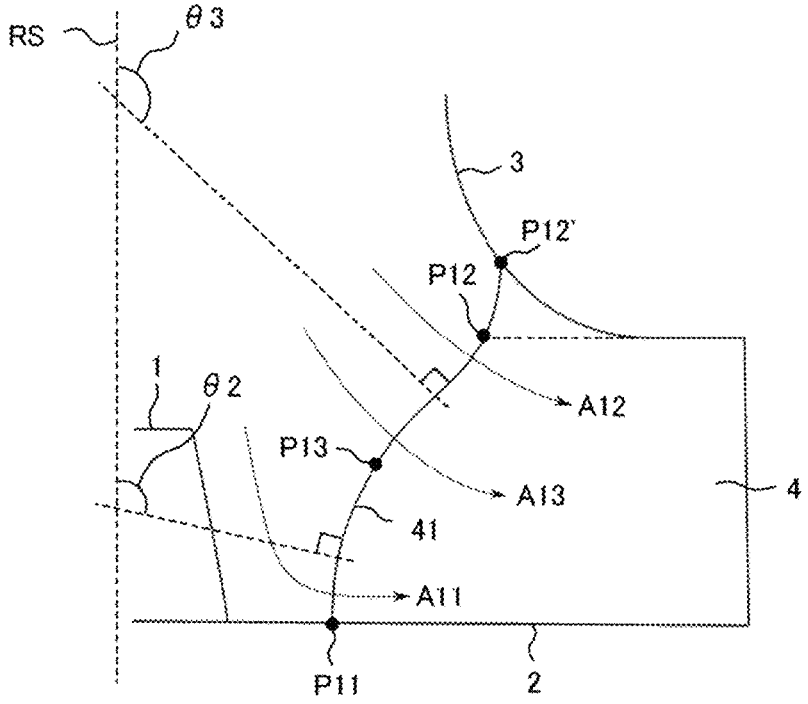
FIG. 9 is a meridional view of essential parts of the blade of the turbofan according to Embodiment 3.

FIG. 9 is a meridional view of essential parts of the blade 4 of the turbofan 100 according to Embodiment 3. The meridian view is a view of a plane of a rotation body formed by rotating the blade 4 when it is cut along the plane containing the rotating shaft RS.

As shown in FIG. 9, in the meridian view of the blade 4, an angle 83 formed by the normal of the leading edge 41 on the shroud 3 side and the rotating shaft RS is larger than an angle 82 formed by the normal of the leading edge 41 on the main plate 2 side and the rotating shaft RS. As described above, the blade 4 according to Embodiment 3 is configured with the first inflection point P13 being positioned closer to the point P11 than the point P12 is in the top view as viewed in the axial direction of the rotating shaft RS. Therefore, the angle 83 between the normal of the leading edge 41 and the rotating shaft RS on the shroud 3 side is larger than the angle 82 between the normal of the leading edge 41 and the rotating shaft RS on the main plate 2 side.

In this configuration, the airflow A11 on the main plate 2 side, the airflow A12 on the shroud 3 side, and the airflow A13 between the main plate 2 and the shroud 3 each flow in the normal direction to the leading edge 41 of the blade 4. On the shroud 3 side, the airflow A12, which flows obliquely to the cross section of the blade 4, can be adjusted so that the normal direction of the leading edge 41 of the blade 4 is the direction of inflow of the airflow A12.

According to the turbofan 100 according to Embodiment 3 described above, the normal direction of the leading edge 41 of the blade 4 can be adjusted to match the air inflow direction, whereby flow loss is reduced, fan efficiency is improved, and fan noise is reduced.

Embodiment 4

Figure 10:
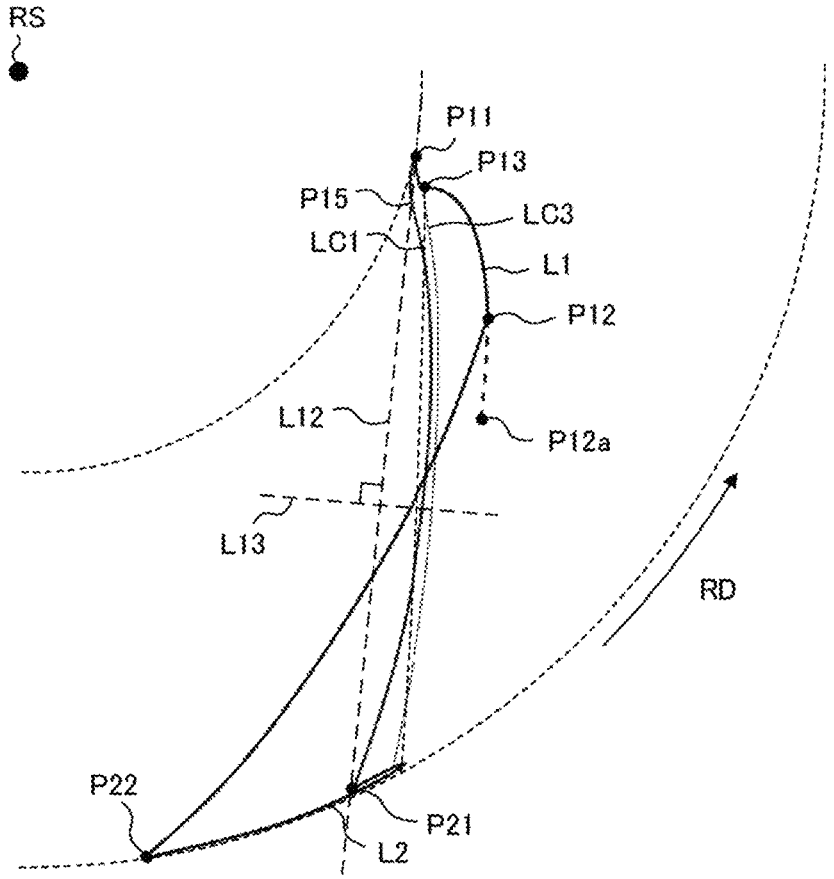
FIG. 10 is a top view of a blade of a turbofan according to Embodiment 4, as viewed in the axial direction of a rotating shaft.

FIG. 10 is a top view of a blade of a turbofan according to Embodiment 4, as viewed in the axial direction of a rotating shaft RS. Since the configuration of Embodiment 4 differs from that of Embodiment 1 in the configuration of the blade 4 and is otherwise similar to that of Embodiment 1, the explanation is omitted and similar or equivalent parts are marked with the same referential signs.

As shown in FIG. 10, the blade 4 is configured with a second inflection point P15 where the direction of curve of the camber line in the cross section perpendicular to the rotating shaft RS changes at least in part from the main plate 2 side to the first inflection point P13.

A wing chord, which is a straight line passing through the leading edge 41 and the trailing edge 42 in a certain section of the blade 4, is defined as the second straight line L12. In FIG. 10, a straight line L12 relative to a cross section passing through point P11 of the blade 4 is illustrated as an example. A line perpendicular to the second line L12 is defined as the third line L13. Then, a coordinate system defined by the second straight line L12 and a third straight line L13 is considered. The direction of curve of the camber line LC1 in the cross section perpendicular to the rotating shaft RS of the blade 4 changes at the second inflection point P15 relative to the coordinate system. The blade 4 has a configuration in which the direction of curve of the camber line changes at the second inflection point P15, at least in part from the cross section on the main plate 2 side to the cross section at the first inflection point P13. The blade 4 may be configured with the second inflection point P15 at all positions from the main plate 2 side to the height of the first inflection point P13.

According to this configuration, on the main plate 2 side, an area near a leading edge of a cross section of the blade 4 is convex in the counter-rotational direction, resulting in a counter-sloped configuration. The camber line on the main plate 2 side of blade 4 is counter-sloped so that it is convex in the counter-rotational direction, so that the inlet angle of the cross-sectional shape of the blade 4 matches the inflow velocity of the airflow. Among the angles formed by the tangent line at the leading edge 41 of an imaginary circle passing through the leading edge 41 with the rotating shaft RS as the origin and the tangent line at the leading edge 41 of the camber line of the blade 4 at the leading edge 41, the inlet angle is an angle which is on the negative pressure surface of blade 4 and on a side in the counter-rotational direction of the blade 4.

The leading edge 41 on the main plate 2 side of the blade 4 is closer to the hub 1 than the leading edge 41 on the shroud 3 side, because the inner diameter, which is the distance from the rotating shaft RS, is smaller than the leading edge 41 on the main plate 2 side than that on the shroud 3 side. At the leading edge 41 on the main plate 2 side of the blade 4, the airflow is affected by the viscosity of the main plate 2, which tends to reduce radial components of the air inflow velocity. By properly designing the inlet angle, collision loss between the airflow and the blade 4 at the leading edge 41 of the blade 4 or separation of the airflow at the leading edge 41 is effectively suppressed, resulting in improved fan efficiency and reduced fan noise.

The turbofan 100 according to Embodiment 4 described above has a configuration in which the direction of curve of the camber line of the blade 4 is varied. By designing the shape of the blade 4 so that the inlet angle matches the inflow velocity of the airflow, the collision loss caused by collision of the airflow and the blade 4 at the leading edge 41 of the blade 4 and the separation of the airflow from the blade 4 can be effectively suppressed, resulting in improved fan efficiency and reduced fan noise.

Embodiment 5

Figure 11:
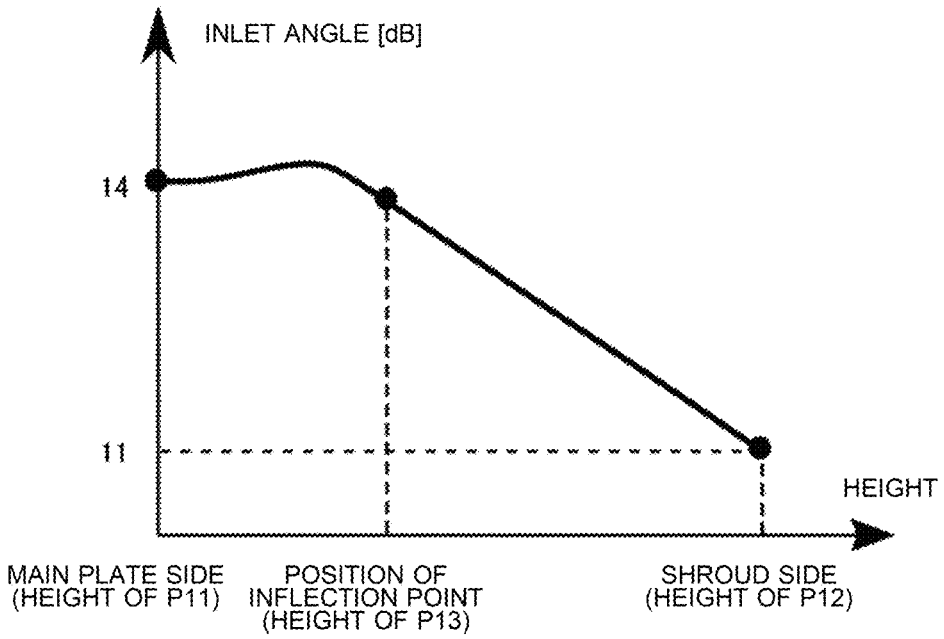
FIG. 11 is a graph showing a relationship between a height of a leading edge and an inlet angle of a blade of a turbofan according to Embodiment 5.

FIG. 11 is a graph showing a relationship between a height of a leading edge and an inlet angle of a blade of a turbofan 100 according to Embodiment 5. Since the configuration of Embodiment 5 differs from that of Embodiment 1 in the configuration of the blade 4 and is otherwise similar to that of Embodiment 1, the explanation is omitted and similar or equivalent parts are marked with the same referential signs.

As shown in FIG. 11, the blade 4 is configured so that, when the height of the leading edge 41 of the blade 4 is greater than the first inflection point P13, the angle on the side in the counter-rotational direction of the inlet angle is progressively decreased. The height of the leading edge 41 of the blade 4 is a vertical distance from the main plate 2 to the leading edge 41 of the blade 4, and is the distance in the +Z direction when the origin is the intersection of the main plate 2 and the rotating shaft RS. The inlet angle is an angle between the tangent line at the leading edge 41 of a circle having the rotating shaft RS as the origin and passing through the leading edge 41 of the blade 4 and the camber line of the blade 4 at the leading edge 41, as described above. In other words, the blade 4 has a configuration in which the inlet angle in the cross section perpendicular to the rotating shaft RS is progressively reduced from the cross section of the blade 4 with the first inflection point P13 of the leading edge line L1 as the leading edge 41 to the cross section of the blade 4 on the shroud 3 side.

The airflow at the leading edge 41 is easily affected by the hub 1 and the main plate 2 on the side of the main plate 2 where the inner diameter of the blade 4 is reduced. The airflow at the leading edge 41 is no longer affected by the hub 1 and the main plate 2 as it moves toward the shroud 3 side, and the inlet angle of airflow relative to the cross section of the blade 4 tends to decrease.

Therefore, the inlet angle of the blade 4 is configured such that it decreases on the shroud 3 side, which suppresses the collision loss of airflow for the blade 4 or the separation of airflow from the leading edge 41 of the blades 4, thereby improving fan efficiency and reducing fan noise.

According to the turbofan 100 according to Embodiment 5 described above, when the height of the leading edge 41 of the blade 4 becomes greater than the height of the leading edge 41 at the first inflection point P13, the inlet angle of the blades 4 is progressively reduced. The inlet angle of the blade 4 gradually decreases. Therefore, the collision loss of the airflow that flows to the blade 4 and separation of the leading edge are suppressed, and the fan efficiency can be improved and the fan noise can be reduced.

Embodiment 6

FIG. 12 is a schematic view illustrating an inside of an air-conditioning apparatus according to Embodiment 6. Embodiment 6 relates to an air-conditioning apparatus 200 provided with the turbofan 100 according to any one of Embodiments 1 to 5, and as for parts similar to or equivalent to those in Embodiments 1 to 5, an explanation is omitted and are marked with the same referential signs.

As shown in FIG. 12, the air-conditioning apparatus 200 includes a turbofan 100 with the blade 4 and a motor 201 connected to the turbofan 100 via a shaft 201*a*. A heat exchanger 202 is located on the air-outlet side of the turbofan 100. On the air-inlet side of the turbofan 100 is a bell mouth 203 is provided.

When the turbofan 100 is driven to rotate, an airflow is sucked into the interior of the air-conditioning apparatus 200 through an air inlet 205. After passing through the bell mouth 203, the turbofan 100, and the heat exchanger 202, the airflow is blown out of the air-conditioning apparatus 200 from an air outlet 204.

Since the airflow blown out of the turbofan 100 has a uniform velocity distribution at the outlet, the velocity distribution of the airflow entering the heat exchanger 202 is also uniform. This brings about an effect of reducing the pressure loss of the airflow when it passes through the heat exchanger 202 and improving the heat exchange performance, contributing to improved performance and energy savings for the air-conditioning apparatus 200 as a whole.

EXAMPLES

An evaluation on the performance of the turbofan 100 pertaining to Example will be described next. The evaluation on performance was conducted is based on comparative experiments between the turbofan 100 of Example and a turbofan of Comparative Example with a general configuration.

In the experiment, the turbofan 100 of Example and the turbofan of Comparative Example are configured with blades with a diameter of 480 [mm] as the blade 4, and each are mounted on an air-conditioning apparatus for use on the laboratory basis.

Next, the turbofan 100 of Example and the turbofan of Comparative Example installed in the air-conditioning apparatus were driven at a predetermined number of revolutions. Measurements of airflow, motor input, and noise levels were conducted under conditions where the differential pressure between the air inlet 205 and the air outlet 204 of the air-conditioning apparatus was zero. The noise level was measured at a distance of 1 m away from the air inlet 205 perpendicular to the suction surface under conditions where the differential pressure between the air-inlet 205 and the air-outlet 204 is zero.

Figure 13:
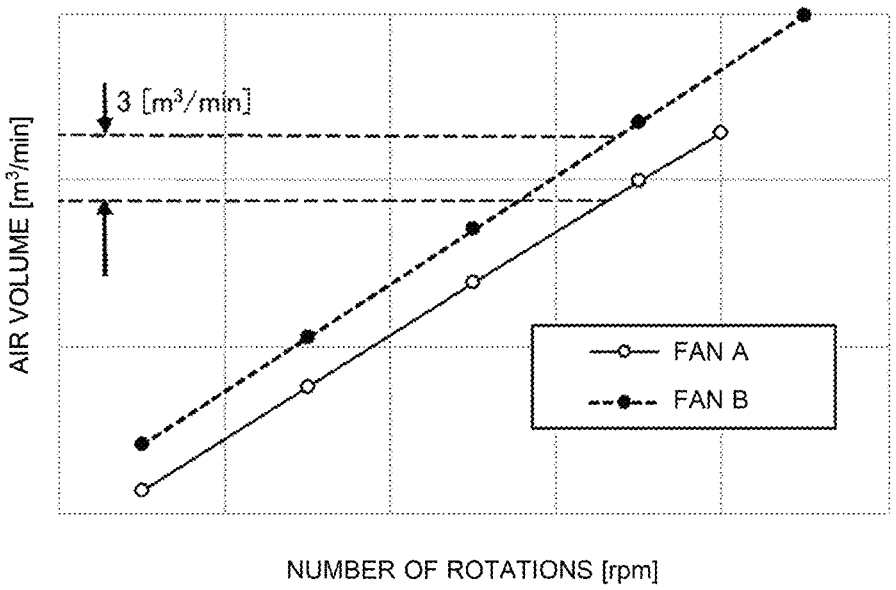
FIG. 13 is a graph showing a relationship between an air volume and a number of revolutions in turbofans of Examples and Comparative Examples.
Figure 14:
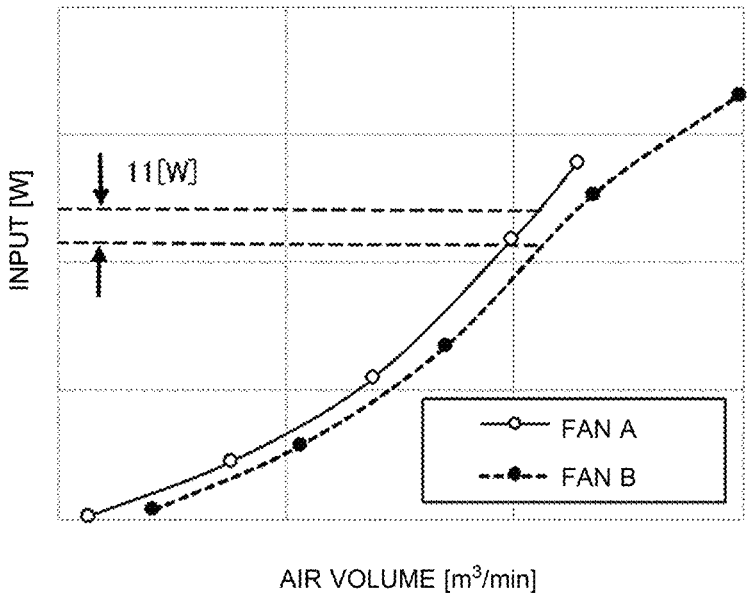
FIG. 14 is a graph showing a relationship between an air volume and an input in the turbofans of Examples and Comparative Examples.
Figure 15:
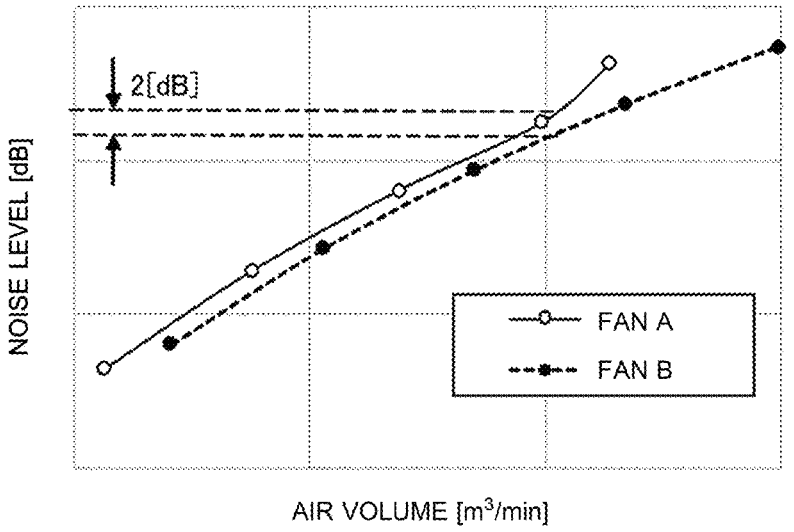
FIG. 15 is a graph showing a relationship between an air volume and a noise level in the turbofans of Examples and Comparative Examples.

FIG. 13 is a graph showing a relationship between an air volume and a number of revolutions in the turbofans of Examples and Comparative Examples. FIG. 14 is a graph showing a relationship between an air volume and an input in the turbofans of Examples and Comparative Examples. FIG. 15 is a graph showing a relationship between an air volume and a noise level in the turbofans of Examples and Comparative Examples. In FIGS. 13 through 15, fan A shows the turbofan of Comparative Example, and fan B shows the turbofan 100 of Example.

As shown in FIG. 13, at the rated speed of each turbofan, as for the airflow at the same number of revolutions, it was found that fan B was larger by approximately 3 [$m^3$/min] compared to fan A. In other words, it was confirmed that the turbofan 100 of Example has an effect of improving the air-sending performance of the fan.

As shown in FIG. 14, at the rated air flow rate of each turbofan, as for the motor input at the same air flow rate, it was found that fan B was smaller by approximately 11 [W] compared to fan A. In other words, it was confirmed that the energy-saving performance of the fan is improved by the turbofan 100 according to Example.

As shown in FIG. 15, at the rated air flow rate of each turbofan, as for the noise level at the same air flow rate, it was found that fan B was smaller by approximately 2 [dB] compared to fan A. In other words, it was found that the turbofan 100 of Example provides an effect of lowering the noise level of the fan.

The above experimental results show that, according to the turbofan 100 of Example, improved air-sending performance, lower input, and lower noise can be realized simultaneously.

REFERENCE SIGNS LIST

1: hub, 2: main plate, 3: shroud, 4: blades, 4*a*; outer surface, 4*b*: inner surface, 41: leading edge, 42: trailing edge, 100: turbofan, 200: air-conditioning apparatus, 201: motor, 201*a*: shaft, 202: heat exchanger, 203: bell mouth, 204: air outlet, 205: air inlet

The invention claimed is:

1. A turbofan comprising:

a main plate provided with a hub to which a rotating shaft is connected, a shroud positioned so as to face the main plate, and a plurality of blades positioned between the main plate and the shroud, each of the plurality of blades has a leading edge and a trailing edge, the trailing edge being located further from the rotating shaft than the leading edge, the leading edge being located forward in a rotational direction than the trailing edge, when a junction point of the leading edge with the main plate is named as a first point, and an intersection of the leading edge and an imaginary plane passing through an outermost circumference of the shroud and being perpendicular to the rotating shaft is named as a second point, a first curve, formed by projecting the leading edge onto a plane perpendicular to the rotating shaft, has a first inflection point relative to a coordinate system in which an imaginary straight line passing through the first point and the second point is an abscissa and the rotational direction side is positive in a top view as viewed in an axial direction of the rotating shaft, the first curve has a portion that is convex in a counter-rotational direction between the first inflection point and the first point and a portion that is convex in the rotational direction between the second point and the first inflection point, the first point is located forward of the second point in the rotational direction, a second curve, formed by projecting the trailing edge onto the plane perpendicular to the rotating shaft, follows an arc centered on the rotating shaft in the top view as viewed in the axial direction of the rotating shaft, a third curve, formed by projecting the trailing edge onto a cylindrical plane coaxial with the rotating shaft, is formed so as to be convex in the rotational direction, and a junction point of the third curve and the shroud is located behind a junction point of the third curve and the main plate in the rotational direction.

2. The turbofan of claim 1, wherein the first inflection point is present singly on the first curve.

3. The turbofan of claim 1, wherein, in each of the plurality of blades, a center line in a thickness direction in a surface where each of the plurality of blades is in contact with the main plate, and a center line in the thickness direction of each of the plurality of blades in the imaginary plane passing through the outermost circumference of the shroud and being perpendicular to the rotating shaft intersect in a top view as viewed in a direction of the rotating shaft.

4. The turbofan of claim 1, wherein, in a top view as viewed in an axial direction of the rotating shaft, a distance between the first inflection point and the first point is shorter than a distance between the first inflection point and the second point.

5. The turbofan of claim 1, in at least part of an area extending from a cross section of the blade in a plane that passes the first point and is perpendicular to the rotating shaft to a cross section of the blade in a plane that passes the first inflection point and is perpendicular to the rotating shaft, in a coordinate system defined by the first straight line that passes the leading edge and the trailing edge in a cross section of the blade in the plane perpendicular to the rotating shaft, a second straight line perpendicular to the first straight line, a center line of the direction of curve in a thickness direction of the blade has the second point.

6. The turbofan of claim 1, wherein, in a cross-section of the blade in the plane perpendicular to the rotating shaft, among inlet angles, each of which being an angle formed by a tangent line at the leading edge of a circle having the rotating shaft as its origin and passing through the leading edge, and a tangent line at the leading edge of the center line in a thickness direction of the blade, the angle on a counter-rotational side of the blade is progressively decreased from a cross section of the blade in the plane perpendicular to the rotating shaft and passes through the first inflection point to a plane where the blade and the shroud are in contact.

7. An air-conditioning apparatus which comprises the turbofan of claim 1, and has a heat exchanger on an air-outlet side of the turbofan.

8. The turbofan of claim 1, wherein, when a junction point of the leading edge and the shroud that is farthest from the main plate is named as a third point, and a trajectory formed by the leading edge from the first point to the third point is named as a leading edge line, the leading edge line is convex in the rotational direction between a point corresponding to the first inflection point on the leading edge line, and the second point.

9. The turbofan of claim 1, wherein the third curve is convex in the rotational direction relative to a straight line formed by projecting the rotating shaft on the cylindrical plane.

* * * * *